US008202166B2

(12) United States Patent
Green

(10) Patent No.: US 8,202,166 B2
(45) Date of Patent: Jun. 19, 2012

(54) MULTIPLE-PLAYER COLLABORATIVE CONTENT EDITING

(75) Inventor: Tyson Green, Snohomish, WA (US)

(73) Assignee: Microsoft Corporation, Redmond, WA (US)

( * ) Notice: Subject to any disclaimer, the term of this patent is extended or adjusted under 35 U.S.C. 154(b) by 614 days.

(21) Appl. No.: 12/114,830

(22) Filed: May 5, 2008

(65) Prior Publication Data

US 2009/0275412 A1 Nov. 5, 2009

(51) Int. Cl.
*A63F 9/24* (2006.01)

(52) U.S. Cl. ..... 463/42; 463/31

(58) Field of Classification Search ..... 463/42
See application file for complete search history.

(56) References Cited

U.S. PATENT DOCUMENTS

| | | | | |
|---|---|---|---|---|
| 5,680,534 | A | 10/1997 | Yamato et al. | |
| 5,898,434 | A * | 4/1999 | Small et al. | 715/810 |
| 6,104,397 | A * | 8/2000 | Ryan et al. | 715/846 |
| 6,338,680 | B1 | 1/2002 | Connors | |
| 6,394,895 | B1 * | 5/2002 | Mino | 463/3 |
| 7,249,314 | B2 | 7/2007 | Walker et al. | |
| 2001/0049717 | A1 * | 12/2001 | Freeman et al. | 709/203 |
| 2003/0224856 | A1 * | 12/2003 | Bukovsky et al. | 463/42 |
| 2004/0219976 | A1 * | 11/2004 | Campbell | 463/31 |
| 2005/0010874 | A1 | 1/2005 | Moder et al. | |
| 2007/0060327 | A1 | 3/2007 | Curtis | |
| 2007/0077996 | A1 | 4/2007 | Chiu et al. | |
| 2007/0098297 | A1 | 5/2007 | Fushiki et al. | |
| 2007/0178968 | A1 | 8/2007 | Cote-Charpentier et al. | |

OTHER PUBLICATIONS

Gray, et al., "Video Games: A New Interface for Non-Professional Game Developers", Presented at the ACM International Conference on Computer-Human Interaction (CHI 2007), Workshop on Supporting non-professional users in the new media landscape, pp. 1-4.

Educause Learning Initiative, "7 Things You Should Know About Collaborative Editing", Dated: Dec. 2005, 2 pages.

Brudvig, "GC 2007: Halo 3—The Forge", Dated: Aug. 23, 2007, http://uk.xbox360.ign.com/articles/815/815041p1.html.

Masuch, et al., "Challenges in Collaborative Game Design Developing Learning Environments for Creating Games", Proceedings of the Third International Conference on Creating, Connecting and Collaborating through Computing (C5'05), Dated: Jan. 28-29, 2005, pp. 67-74.

* cited by examiner

*Primary Examiner* — Omkar Deodhar
(74) *Attorney, Agent, or Firm* — Mayer & Williams P.C.

(57) ABSTRACT

An arrangement is provided for multiplayer collaborative content editing which allows players to edit content and enjoy a social collaborative process. The arrangement provides a gameplay environment for custom or "honor rule" gametypes, and allows multiple users to participate in a full-featured game environment. The multiple user editing scenarios may be employed on, e.g., a single game console in a splitscreen version, over a LAN with multiple game consoles, or over the internet. Users may toggle between a "Player Mode", with a similar appearance and capabilities as a player in a traditional multiplayer game, and an "Edit Mode", which may have different appearance and capabilities. The Edit Mode presents the user with editing functionality and a suitable user interface, as well as a number of additional abilities beyond that of a user in Player Mode.

13 Claims, 6 Drawing Sheets

MULTIPLE-PLAYER COLLABORATIVE CONTENT EDITING

BACKGROUND

In multiplayer games, content editing is often encouraged by publishers. Content editing often increases player enjoyment as players can adapt the game to their own needs and desires. Increased player enjoyment in turn leads to increased play and thus revenue.

Game content editing, often termed "molding", is sometimes so encouraged that publishers create mod editing tools specifically for this purpose. Other publishers may make source code available for users to work with for this purpose.

However, content editing is generally not a social process. As such, it often fails to draw players to itself Consequently, content editing is usually limited to a very small percentage of players.

SUMMARY

The arrangement for multiplayer collaborative content editing offers players a way to edit content and enjoy a social collaborative process while doing so. The arrangement also provides a desirable gameplay environment for custom or "honor rule" gametypes. The arrangement allows multiple users to participate in a full-featured game environment, with expanded abilities that allow the users to manipulate content in that environment. The manipulations or changes can then be saved for use in other game modes or for distribution to other players. At any time, more than one player may be engaging in editing activities while cooperating with other players who are working in the same environment.

The editing environment may also be a full-featured game environment, or a distinct mode of the same, so players may engage in adversarial gameplay with the same expanded abilities that make editing possible. This feature allows support for a variety of gametypes, including custom or "honor rule" gametypes.

The multiple user editing scenarios may be performed on varying types of systems, including: a single game console in a splitscreen version; over a local area network with multiple game consoles; or over the internet. Other types of systems may also be employed.

Users may toggle freely between a "Player Mode", with a similar appearance and capabilities as a player in a traditional multiplayer game, and an "Edit Mode", which may have somewhat or significantly different appearance and capabilities. The Edit Mode then presents the user with editing functionality and a suitable user interface. The Edit Mode also presents the user with a number of additional abilities beyond that of a user in Player Mode, such as creation and deletion of objects, manipulation of existing objects, editing of object properties, an ability to end a game round and reset a map, an ability to name and save a modified map for use in other game modes or for distribution to other players, a free-moving flying camera mode, and various other capabilities as desired.

To support this mode, the game environment may be supplied with settings that control the types and numbers of objects that may be created. To guard against situations where excessive object creation could cause performance (e.g., frame rate) degradation and a poor user experience, a budget may be instituted. Objects may then be assigned a cost based on their performance characteristics. For example, objects that affect performance more cost more. The cost of objects may be deducted from the budget when the object is created, and once depleted, no more objects may be created.

A game option may allow a game session leader to restrict the ability to enter Edit Mode to only one person if desired, while other players remain in the game in Player Mode.

Advantages of the system and method may include one or more of the following. New users or users previously uninterested in unsociable activities like traditional content editing.

This Summary is provided to introduce a selection of concepts in a simplified form. The concepts are further described in the Detailed Description section. Elements or steps other than those described in this Summary are possible, and no element or step is necessarily required.

This Summary is not intended to identify key features or essential features of the claimed subject matter, nor is it intended for use as an aid in determining the scope of the claimed subject matter. The claimed subject matter is not limited to implementations that solve any or all disadvantages noted in any part of this disclosure.

DETAILED DESCRIPTION

Figure 1:
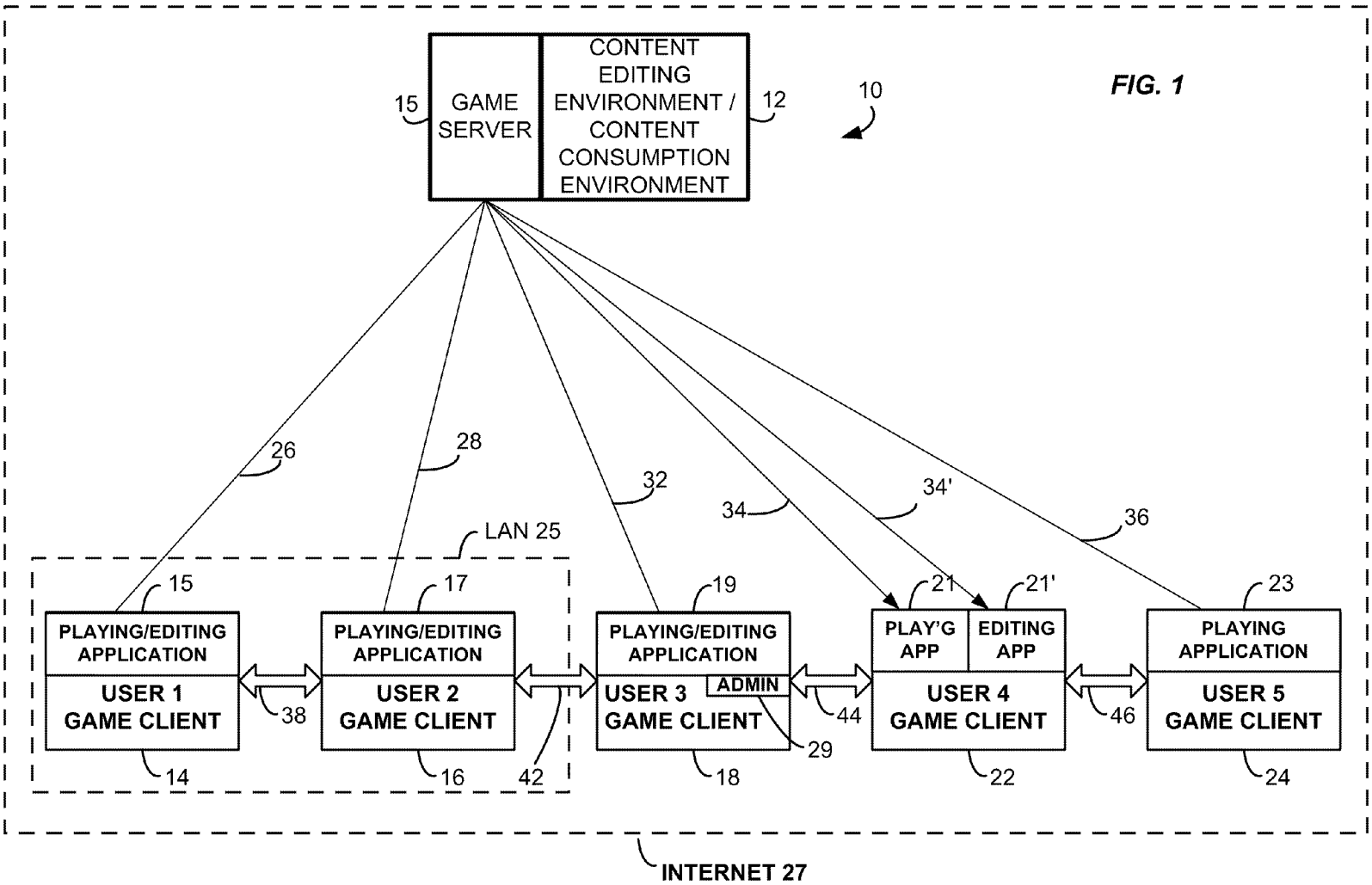
FIG. 1 illustrates a schematic arrangement of an exemplary client/server environment.

The following definitions are employed.

"Content", "content items", "items of content" or the like generally refer to objects in video games. The same may be objects that a player character carries in their inventory, or objects that make up the background or other scenery. For example, a content item may be a sword, a food item, a rock or tree, and the like. Other such objects may be "maps" or "properties", both of which may also be the subject on content editing. Maps generally refer to a level that may be traversed by a player character. Game properties may be the length of time that a game is played, who among the users can play, what characters they play, and so on.

"Editing content" and the like refers to the act of modifying content items, maps, properties, and the like. As such, it may include adding items, deleting items, modifying items, such as by modifying their appearance or other properties, and so on.

"Consuming content" and the like refers to using an application containing that content to perform a task. The task may be to play a game, perform a work function, or any number of other tasks.

"Signal communication" refers to a component being coupled to another such that signals and the information contained therein can be transmitted from the one component to the other. In some cases, the transmission is made by way of a conductor. In other cases, optical transmission is made. In still other, wireless transmission is made via RF signals or the like.

"First application" or "game playing application" refers to the application employed to consume content on a client system. In game systems, it is the application used to play the game. The first application can vary in size and complexity. In some game systems the first application constitutes much of the game, and only a minor amount of the game resides on a server, the minor amount being that used by players to interact, and so on. In many game situations, however, much of the game resides on the server, and the client-side component is reserved for control and routing of various input signals. Here, the first application refers to that transmitted to, loaded on, or run by a client system is order to consume the application, including consuming the application's content.

"Second application" or "game content editing application" refers to the application employed to edit content on a client system. In game systems, it is the application used to edit the game content. The second application can vary in size in complexity for the same reasons as the first application, and further by virtue of the complexity of the same's editing tools.

"Single application" refers to a combination of the first application and the second application, e.g., the combination of a game playing application and a game content editing application. In some arrangements, the first application and the second application may be considered separate, and downloaded, loaded, transmitted, or run separately. In other arrangements, the two may be combined into a single application, and it is this single application that may be downloaded, loaded, transmitted, or run. The single application may be more convenient as only one application is involved.

"Toggle" or "switch" or the like refers to a button generally formed as part of a user interface. When this button is selected or clicked, the display may switch from a content editing display to a game playing display.

"Game console" (which can be a computer) refers to a dedicated component on which content may be consumed or edited. In the case of a computer, the same need not be dedicated solely to that purpose, but the functions of content consumption or editing are retained. In some systems, as will be described, editing and playing or consumption may both be performed. In other, only content consumption or playing may be performed.

Finally, a "display" is a physical device to which a video output is sent. A "display screen" is the total visual display area of a display. A "window" is a visual area on a display screen generally containing a user interface for a computing device process. In the arrangements described here, a game content editing window and/or a game playing window generally occupy a display screen of a display. A "split-screen" display refers to having two windows open in a display screen, e.g., one for editing and one for playing, two for editing (where different users are editing at the same time), etc. A "dual-screen" display refers here to a system in which a user can switch between two windows on a display screen using, e.g., a toggle switch button or the like.

Referring to FIG. 1, an arrangement 10 is shown for multiplayer content editing and consumption. The arrangement 10 includes a game server 15 that defines a content editing environment and a content consumption environment 12.

The arrangement 10 is in signal communication with a plurality of clients 14, 16, 18, 22, and 24. Of course, more or less clients may be involved, and generally many more are. The arrangement 10 may be in signal communication with the clients 14, 16, 18, 22, and 24 through any network, such as the Internet or a LAN system, including a WLAN. FIG. 1 shows a number of communications links: client 14 is connected to arrangement 10 via link 26, client 16 via link 28, client 18 via link 32, client 22 via link 21, and client 24 via link 36. Links 26, 28, 32, 34, and 36 may be via any known transmission method and medium, now or later developed. Clients 14, 16, 18, 22, and 24 may communicate between themselves by one or more chat channels 38, 42, 44, or 46, which may be text, audio, video, or a combination. The chat channels are shown between the clients, but would be implemented, created, and enabled generally as part of the arrangement 10. Moreover, while the chat channels are shown between adjacent clients, it is to be understood that a chat channel could exist between any pair of clients, as well as between any set of clients, where the set of clients includes any number of clients.

The chat functionality may be useful for situations in which multiple users are performing editing functions via a network, rather than via a split-screen as discussed below. If users are connected to the game server via a network, collaborative editing is enhanced by the ability to communicate with one another, and the chat functionality enables this communication. On the other hand, if a single computing system is used for editing, e.g., a game console with multiple input devices, then users may simply communicate without any sort of chat functionality.

Each client 14, 16, 18, 22, and 24 has situated thereon an application. Clients 14, 16, and 18 each have a single playing/editing application 15, 17, and 19, respectively, thereon, and the single playing/editing application may be placed thereon via downloading, loading via removable media, a server transfer, or via any other method. The single playing/editing application may be conveniently placed on the client system in a single step, and can afford the user the ability to play the game as well as to edit content therein, as will be described below. The client 24 has a playing application 23 placed thereon. In other words, the client 24 can consume content, e.g., play a game, but cannot edit content. The client 22 has a playing application 21 placed thereon, as well as an editing application 21'. In this figure, these are shown schematically as having been downloaded via links 34 and 34', respectively. Links 34 and 34' are intended to show that the applications were placed on the client 22 in two steps, one application per step. Link 34 and 34' may constitute physically the same communication path. Chat functionality may be provided by way of the editing application, the playing application, or both, or via a separate chat channel.

Figure 2:
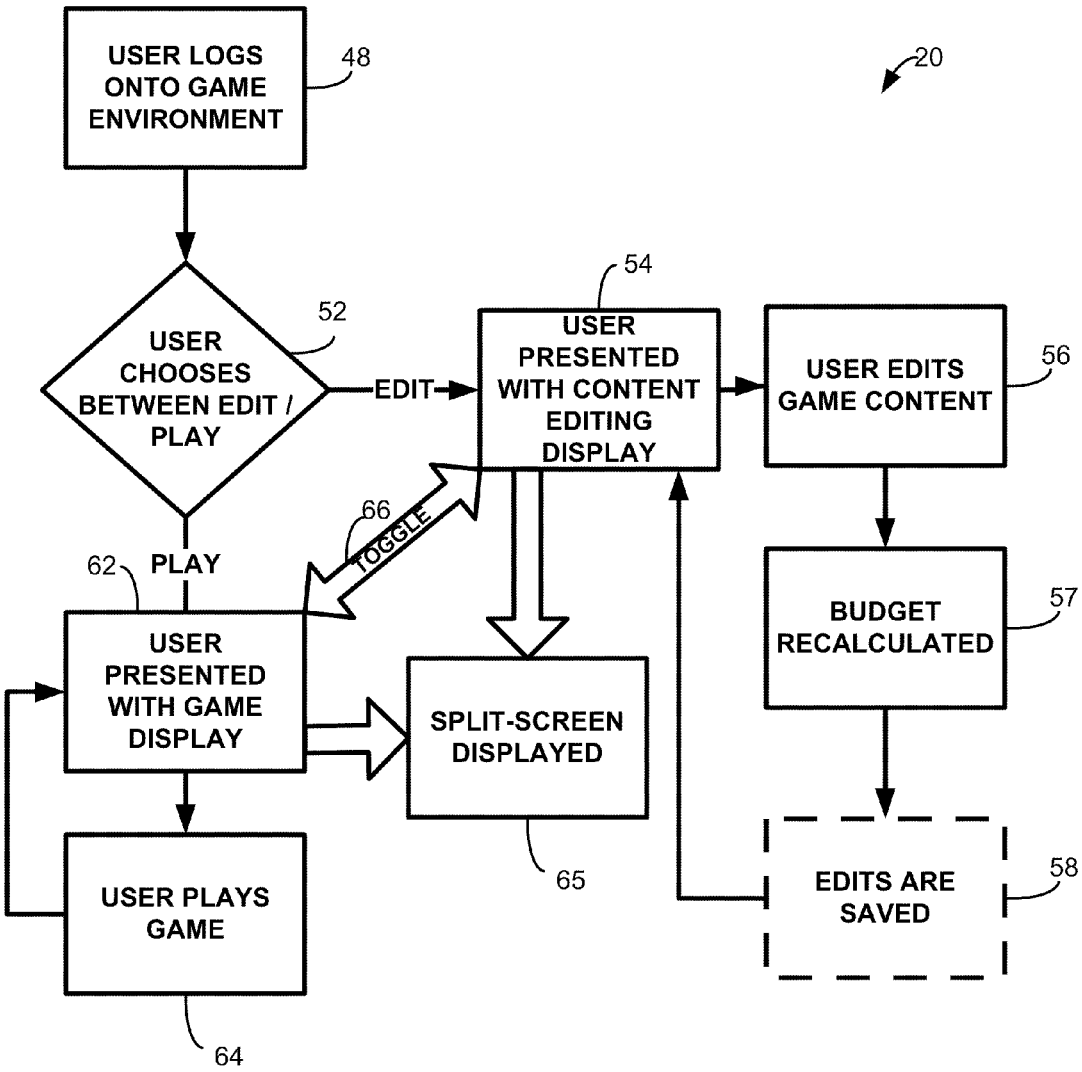
FIG. 2 is a flowchart depicting a method employable by the arrangement of FIG. 1.

FIG. 2 shows a flowchart of a method 20 for content editing and consumption. In a first step, a user logs onto the content editing environment, here shown as a game editing environment (step 48). While game editing and game playing are described here, it is understood that, in general, content consumption and editing in all forms are contemplated. Logging on may be as simple as entering an appropriate URL into a browser field, but generally also includes steps of entering a user identification and password into a verification window. In one exemplary method, the user chooses between editing and playing (step 52), in which case one window is used for editing and the user switches to a different window for playing. In another exemplary method, the user views a dual-screen display, and in this case the choice is between which display is in an active window. In another exemplary method, where two or more users are editing content using a single computing device, or multiple computing devices with the same display, the user may view a split-screen display. The flowchart of FIG. 2 applies to each user—if a split-screen display is employed, any display steps would cause the playing or editing to be displayed on the given user's side of the display. Even in a split-screen display, the given user's side of the display may display multiple windows, for editing, playing, etc.

If the user chooses to play or consume content (step 62), then the user is presented with a game display (step 62), and the user can play the game (step 64). The user can play the game with all the features generally offered by the game, or can play the game with items, maps, and properties as modified by their or others' content editing.

If the user chooses to edit content in the user choice step (step 52), then the user is presented with a game content editing display (step 54). The user may edit the content, such as by adding, deleting, or modifying content items, maps, or properties (step 56). For example, a user may create content items that may be consumed in the game. As described in greater detail below, a budget may be provided to a content editor, and the user may create and modify content according to the constraints of the budget. Once the step of editing game content is performed (step 56), the budget is recalculated (step 57). At any point in the editing process, the edits made by the user may be saved (step 58). Alternatively, an autosave function may also be employed. In a split-screen display where two users are editing content on the same display, a single 'save' operation may save one or both sets of edits. In any case, the process may then repeat.

Figure 3:
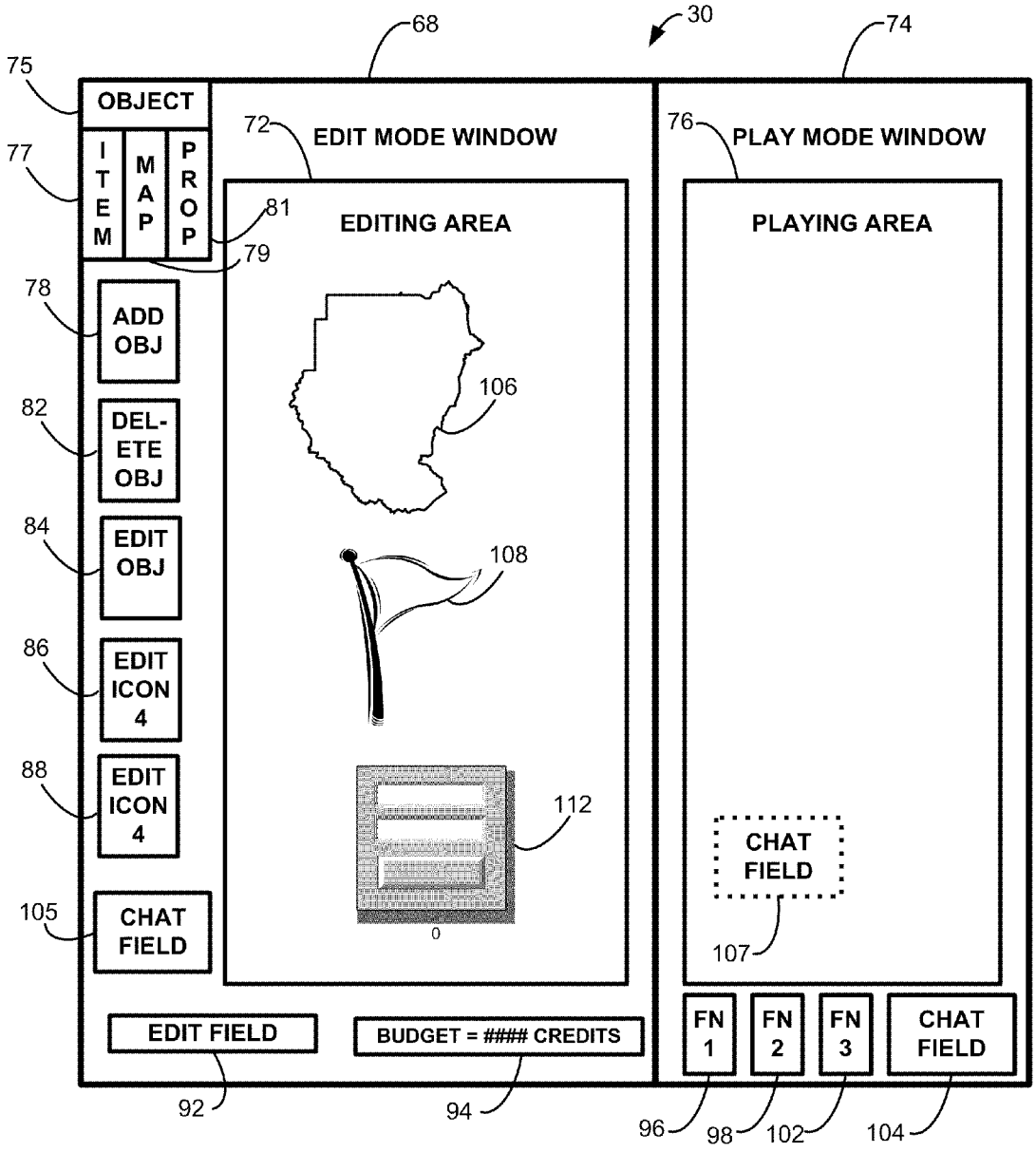
FIG. 3 illustrates an exemplary split-screen user interface.

As indicated in FIG. 2, the method may employ a split-screen display (step 65), in which two windows are present in a single display screen, i.e., the game playing window and the game content editing window (see also FIG. 3). One may be an active window, and the determination of which is active may be determined by user selection, e.g., by clicking in or otherwise indicating the same. In a dual-screen arrangement, each window occupies the display screen area, and a user switches between windows by activating a toggle switch (step 66).

Referring to FIG. 3, an exemplary split-screen display 30 is shown. The split-screen display 30 includes an edit mode window 68 and a play mode window 74. The edit mode window 68 includes an editing area 72 and the play mode window 76 includes a playing area 76. The edit mode window 72 also includes a number of buttons used to edit content, these displayed along the left and bottom edges of the window. The play mode window 76 also includes a number of buttons used to play a game or otherwise consume content, these displayed along the bottom edge of the window.

In more detail, and in one example, the edit mode window 68 may include an object choice button 75. Selecting the same may cycle through the permitted options of content to be edited, such as items, maps, and properties. Selecting button 77 may immediately change the content to be edited to the "item" choice. Selecting button 79 may immediately change the content to be edited to the "map" choice. Selecting button 81 may immediately change the content to be edited to the "property" choice. It is noted here that the "property" may be a property of the game, a property of an item or of a map, a property of a group of items or maps, etc. Generally, the content may be any object intended to be user-modifiable.

Selecting button 78 then adds an object of the type chosen by the button above. Repeated selections of button 78 add additional objects. For example, the object may be added to the center of the editing area, and the user may move the same to a desired location. In one arrangement, the editing area may be displayed as a map, and the user may drag the object to the desired location. In some cases, an altitude field (not shown) may be provided if the object is not to be placed simply on the ground. In the case of content items, shown as item 108, the same may be placed as noted. In the case of map editing, objects 106 may be local (smaller scale) maps, terrain features, rocks, non-player characters, or the like. In the case of game properties, a form 112 may be displayed in which the user may edit modifiable properties.

It is noted that while FIG. 3 displays an object 106, a content item 108, and a form 112 in the same editing area 72, the like may generally be displayed separately, according to the status of buttons 75, 77, 79, and 81.

Selecting button 82 deletes an object of the type chosen by buttons 75, 77, 79, and 81. Repeated selection of button 82 deletes additional objects. For example, the user may select an object using a pointing device and then pressing (clicking on) the button 82 deletes the selected object. It is noted here that the pointing device may be a mouse, keyboard, touch-screen, or any other type of pointing device now known or known in the future.

Selecting button 84 edits an object of the chosen type. As with a deletion, the user may select or highlight an object and then selection of button 84 opens, e.g., an edit dialog box. Other types of edit operations may be employed, including via forms, menus, and the like.

Other buttons, such as buttons 86 and 88, may be employed for any purpose as desired and appropriate in the editing environment.

A chat field 105 may be defined to allow the user to chat with one or more other users in the multiplayer environment. The chat field 105 may be enabled to chat with other players, other content editors, or both.

An exemplary edit field button 92 is displayed. In this field, text may be entered that forms part of an object's appearance or helps to define its properties. For example, the name of a non-player character may be entered. As an another example, a pixel height of an object may be entered.

A field 94 may also be displayed that shows the remaining balance of a budget. In more detail, a budget may be provided to a user, and the same may define in a financial sense the possible edits to the content. For example, a user may be provided a budget of 100 credits, and if large content items cost 10 credits, the user may add 10 large content items before their budget is completely depleted. Similarly, medium-size content items may cost 5 credits, small content items 2 credits, and modification to current content items 3 credits. These values are arbitrary, and any such arrangement may be similarly employed. For example, a user may purchase additional credits, or may use currency as defined within the multiplayer environment to replenish their balance.

It should be noted that any number of types of buttons may be employed to edit or consume content. The buttons shown in FIG. 3 are accordingly merely exemplary of these, and the same perform oft-performed tasks, but are not intended to be exhaustive of the editing and playing tasks performed.

The playing area 76 displays the playing environment as the user has defined it. For example, some users desire to have their playing area be the view through their character's eyes. Other users prefer a camera view where the camera is above and behind their character. The arrangement can allow for any view as defined by the game engine. A chat field 104 or 104' may be displayed to allow the users to communicate with other users. As with chat field 105, the chat field 104 or 104' may be enabled to chat with other players or consumers of content, other content editors, or both. Alternatively, one chat field may be open to chat with players and another for content editors. Function keys 96, 98, and 102, and likely many more, may be employed to allow player input for game play. For example, the same may allow a sword attack, a gun attack, and a spell attack.

For console systems, the above editing and playing features may be accessed and utilized via an attached keyboard. Alternatively, and generally for less complicated edits, a console controller may be employed to effect edits. In this system, arrow keys or a directional pad may allow movement between fields, menus, or buttons, and analog buttons may provide a means to select, highlight, or click on buttons. Of course, this scheme is exemplary, and variations abound.

The editing area 72 and the playing area 76 may be set to display the same view and thus the same portion of the game area. In this way, the user can edit content and immediately see the effects of the editing, or a preview of the editing effects (the edits can either be displayed "on-the-fly", following a "save" command, following a "make edits effective" command, or after any other such indication. In any case, the editing area 72 and the playing area 76 may alternatively be set to be completely independent, and thus have no bearing on each other. In this case, the user may pursue consumption of game content as usual, and edit game content in an unrelated way.

Figure 4:
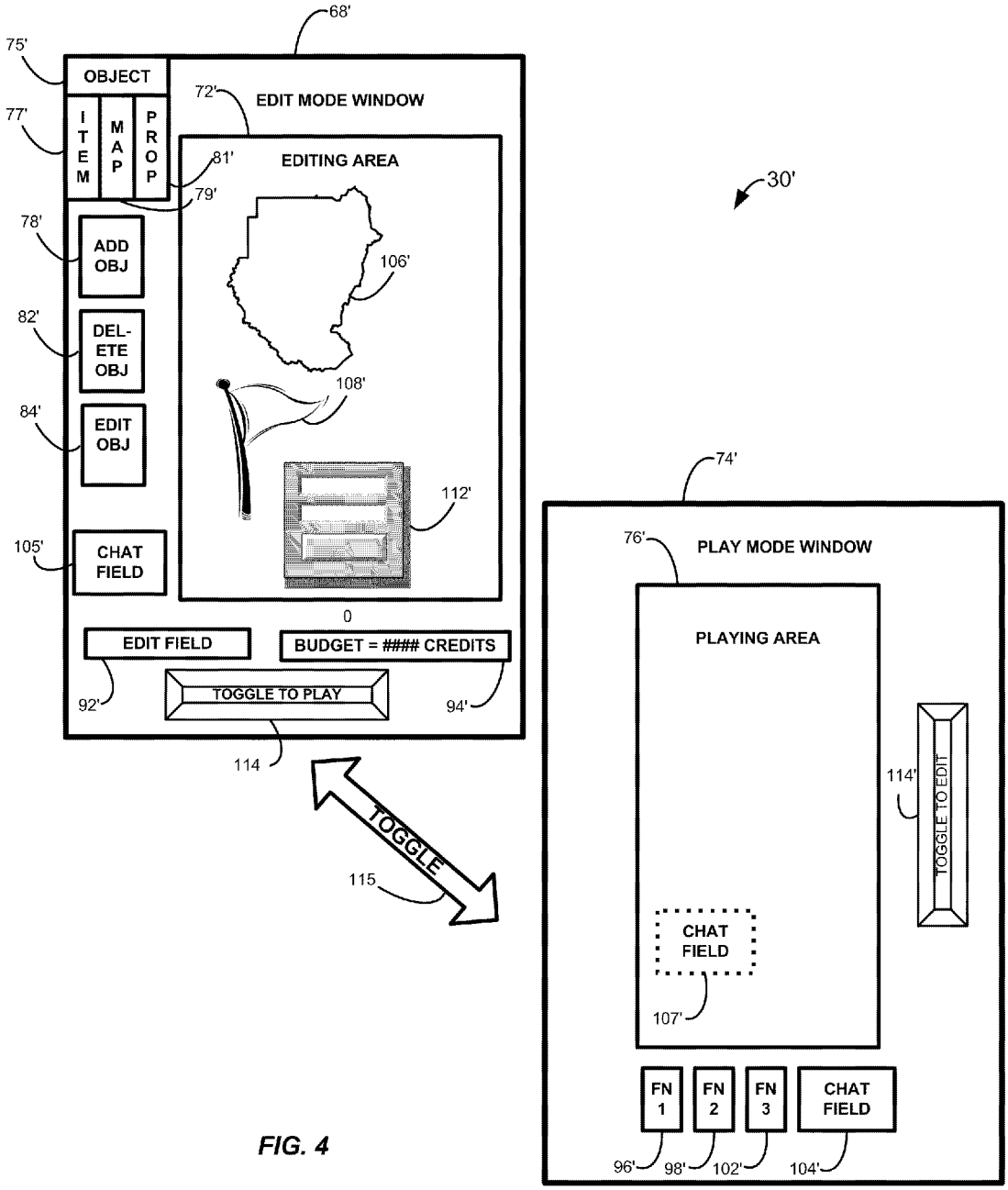
FIG. 4 illustrates an exemplary dual-screen interface, in which a toggle switch button is employed to switch between a content editing window and a content consumption window.

As noted above, the arrangement need not employ a split-screen display. Rather, the edit mode window may occupy the display screen, as may the play mode window, and the user may toggle between the two depending on which action is desired at a given time. This arrangement is shown in FIG. 4, in which user interface components analogous to those on the split-screen arrangement have been replaced by their primed counterparts. FIG. 4 also shows a toggle switch 114. When the display screen is showing the edit mode window 68', the toggle switch 114 may display "Toggle to Play" so that upon selection the display screen switches to the play mode window 74'. Conversely, when the display screen is showing the play mode window 74', a toggle switch 114' may display "Toggle to Edit" so that upon selection the display screen switches to the edit mode window 68'. This toggle functionality is also indicated schematically by arrow 115.

Figure 5:
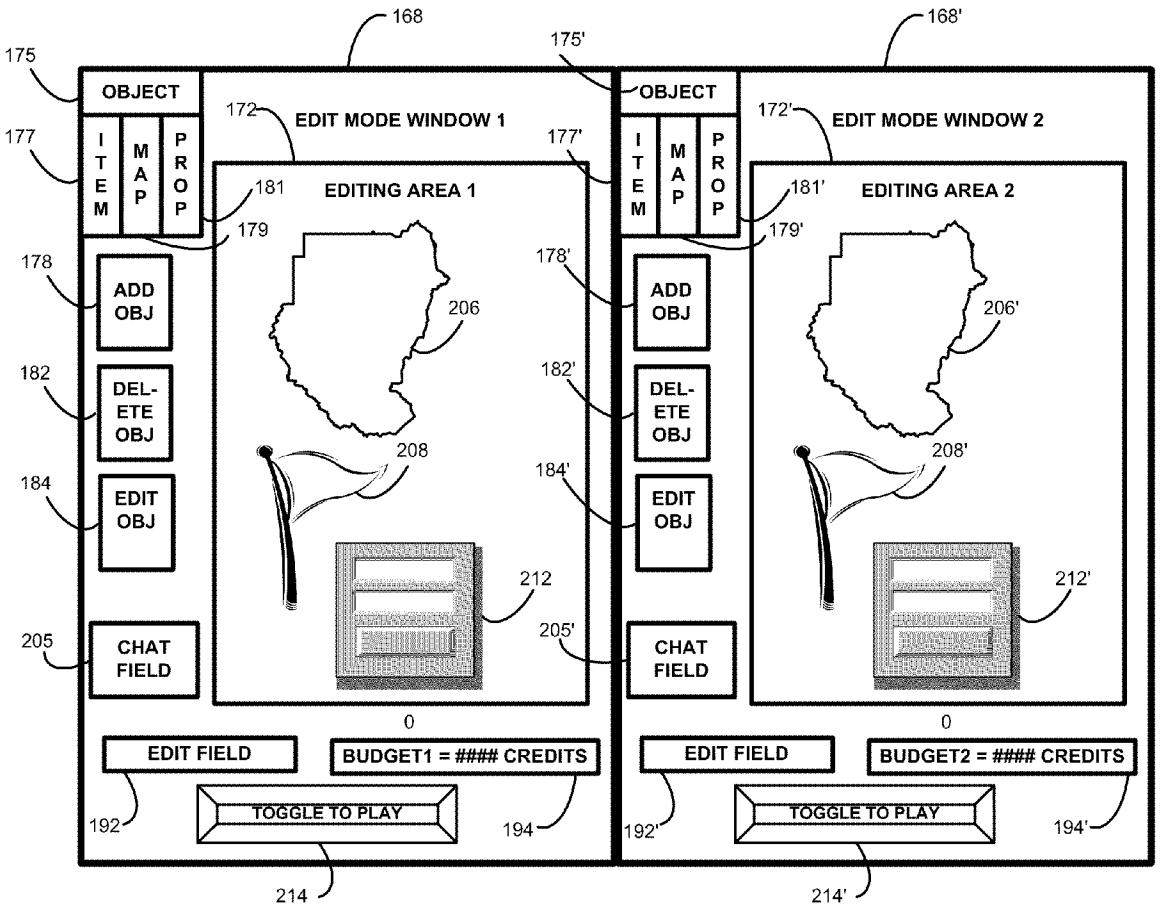
FIG. 5 illustrates an exemplary split-screen interface, in which two users may edit content using a single computing device such as a game console.

Referring to FIG. 5, an exemplary split-screen display 130 is shown which allows content editing by multiple users or players on a single computing device, e.g., a game console, or on multiple computing devices employing the same display. The split-screen display 130 includes two editing windows. A description is given for one such editing window—the description for the second is identical and the counterpart components are indicated in FIG. 5 by primed reference numbers. The layout of the display is described below. Details about the functionality and features of specific buttons and components are described above in connection with corresponding buttons in the other figures.

The display 130 includes an edit mode window 168. The edit mode window 168 includes an editing area 172. The edit mode window 168 also includes a number of buttons used to edit content, these displayed along the left and bottom edges of the window. For example, the edit mode window 168 may include an object choice button 175. Selecting the same may cycle through the permitted options of content to be edited, such as items, maps, and properties. Selecting button 177 may immediately change the content to be edited to the "item" choice. Selecting button 179 may immediately change the content to be edited to the "map" choice. Selecting button 181 may immediately change the content to be edited to the "property" choice.

It is noted that FIG. 5 displays a map feature 206, a content item 208, and a form 212 in the editing area 172, the like may generally be displayed separately, as well as added to, deleted, and modified.

Selecting button 178 adds an object of the type chosen by buttons 175, 177, 179, and 181. Selecting button 182 deletes an object of the chosen type. Selecting button 184 edits an object of the chosen type. Other buttons, such as buttons 186 and 188, may be employed for any purpose as desired and appropriate in the editing environment.

A chat field 205 may be defined to allow the user to chat with one or more other users in the multiplayer environment. An exemplary edit field button 192 is displayed. And a field 194 may also be displayed that shows the remaining balance of a budget.

The counterpart primed components perform similar functions, and thus two users may use the same arrangement to collaboratively edit content. Thus, it can be seen that the arrangements described enable a convenient way to provide content editing and content consumption in a highly social and interactive way, such as in a multiplayer game.

Figure 6:
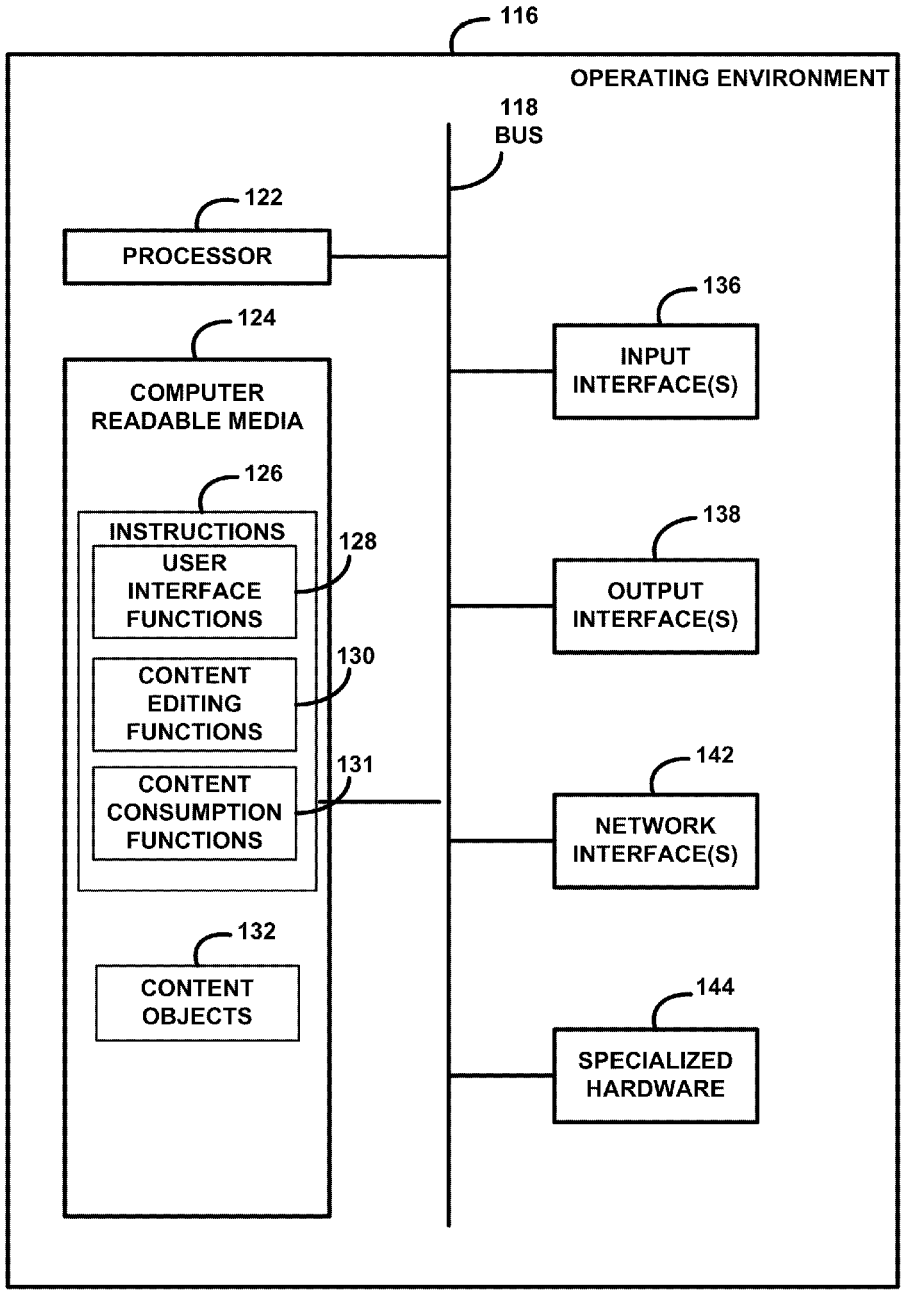
FIG. 6 is a simplified functional block diagram of an exemplary configuration of an operating environment in which the content editing and consumption arrangement may be implemented or used.

FIG. 6 is a block diagram of an exemplary configuration of an operating environment 116 (such as a client-side device or application or a networked server or service) in which all or part of the game server and environment 10 and/or the methods shown and discussed in connection with the figures may be implemented or used. Operating environment 116 is generally indicative of a wide variety of general-purpose or special-purpose computing environments, and is not intended to suggest any limitation as to the scope of use or functionality of the arrangements described herein.

As shown, operating environment 116 includes processor 122, computer-readable media 124, and computer-executable instructions 126. One or more internal buses 118 may be used to carry data, addresses, control signals, and other information within, to, or from operating environment 116 or elements thereof.

Processor 122, which may be a real or a virtual processor, controls functions of the operating environment by executing computer-executable instructions 126. The processor may execute instructions at the assembly, compiled, or machine-level to perform a particular process.

Computer-readable media 124 may represent any number and combination of local or remote devices, in any form, now known or later developed, capable of recording, storing, or transmitting computer-readable data, such as the above-noted computer-executable instructions 126, including user interface functions 128, content editing functions 130, and content consumption functions 131. Computer-readable media 124 may also include content objects 132, such as content items, maps, application properties such as game properties, and so on. In particular, the computer-readable media 124 may be, or may include, a semiconductor memory (such as a read only memory ("ROM"), any type of programmable ROM ("PROM"), a random access memory ("RAM"), or a flash memory, for example); a magnetic storage device (such as a floppy disk drive, a hard disk drive, a magnetic drum, a magnetic tape, or a magneto-optical disk); an optical storage device (such as any type of compact disk or digital versatile disk); a bubble memory; a cache memory; a core memory; a holographic memory; a memory stick; a paper tape; a punch card; or any combination thereof. The computer-readable media may also include transmission media and data associated therewith. Examples of transmission media/data include, but are not limited to, data embodied in any form of wireline or wireless transmission, such as packetized or non-packetized data carried by a modulated carrier signal.

Computer-executable instructions 126 represent any signal processing methods or stored instructions. Generally, computer-executable instructions 126 are implemented as software components according to well-known practices for component-based software development, and encoded in computer-readable media. Computer programs may be combined or distributed in various ways. Computer-executable instructions 126, however, are not limited to implementation by any specific embodiments of computer programs, and in other instances may be implemented by, or executed in, hardware, software, firmware, or any combination thereof.

Input interface(s) 136 are any now known or later developed physical or logical elements that facilitate receipt of input to operating environment 730.

Output interface(s) 138 are any now known or later developed physical or logical elements that facilitate provisioning of output from operating environment 116.

Network interface(s) 142 represent one or more physical or logical elements, such as connectivity devices or computer-executable instructions, which enable communication between operating environment 116 and external devices or services, via one or more protocols or techniques. Such communication may be, but is not necessarily, client-server type communication or peer-to-peer communication. Information received at a given network interface may traverse one or more layers of a communication protocol stack.

Specialized hardware 144 represents any hardware or firmware that implements functions of operating environment 116. Examples of specialized hardware include encoder/decoders, decrypters, application-specific integrated circuits, clocks, and the like.

The methods shown and described above may be implemented in one or more general, multi-purpose, or single-purpose processors. Unless specifically stated, the methods described herein are not constrained to a particular order or sequence. In addition, some of the described methods or elements thereof can occur or be performed concurrently.

Functions/components described herein as being computer programs are not limited to implementation by any specific embodiments of computer programs. Rather, such functions/components are processes that convey or transform data, and may generally be implemented by, or executed in, hardware, software, firmware, or any combination thereof.

It will be appreciated that particular configurations of the operating environment may include fewer, more, or different components or functions than those described. In addition, functional components of the operating environment may be implemented by one or more devices, which are co-located or remotely located, in a variety of ways.

Although the subject matter herein has been described in language specific to structural features and/or methodological acts, it is also to be understood that the subject matter defined in the claims is not necessarily limited to the specific features or acts described above. Rather, the specific features and acts described above are disclosed as example forms of implementing the claims.

It will further be understood that when one element is indicated as being responsive to another element, the elements may be directly or indirectly coupled. Connections depicted herein may be logical or physical in practice to achieve a coupling or communicative interface between elements. Connections may be implemented, among other ways, as inter-process communications among software processes, or inter-machine communications among networked computers.

The word "exemplary" is used herein to mean serving as an example, instance, or illustration. Any implementation or aspect thereof described herein as "exemplary" is not necessarily to be constructed as preferred or advantageous over other implementations or aspects thereof.

As it is understood that embodiments other than the specific embodiments described above may be devised without departing from the spirit and scope of the appended claims, it is intended that the scope of the subject matter herein will be governed by the following claims.

The invention claimed is:

1. In a multiplayer game environment in which game content may be both edited and consumed, a method of game content editing, comprising:

placing a game server in signal communication with a network, the network accessible by a plurality of game clients, the game server and game clients defining a multiplayer environment;

transferring from the game server to the plurality of game clients a game playing application, the game playing application at least allowing a user to play a multiplayer game incorporating game items, game properties, or game maps in the multiplayer environment;

transferring from the game server to at least one of the plurality of game clients a game content editing application, the game content editing application at least enabling one user to edit game content in the multiplayer environment;

displaying user interfaces for the game content editing application and the game playing application on respective different display screens, wherein the enabling includes enabling the user to add, delete, or edit game items, properties, or maps using the game content editing application user interface;

displaying a toggle switch on the game playing application display screen for permitting the user to switch from the game playing application display screen to the game content editing application display screen while a game is being played; and displaying a toggle switch on the game content editing application display screen for permitting the user to switch the user interface from the game content editing application display screen to the game playing application display screen after the user has made any additions, edits, or deletions of game items, properties, or maps using the game content editing application user interface, wherein the user can incorporate any said additions, edits, or deletions into the game being played.

2. The method of claim 1, in which the transferring from the game server to the plurality of game clients includes transferring from the game server to a plurality of game consoles.

3. The method of claim 1, in which the game playing application and the game content editing application are each part of a single application.

4. The method of claim 1, further comprising:

defining at least one client of the plurality of game clients as an administrator; and providing a capability to the administrator game client, for each of the other game clients with the game content editing application, to enable or disable the game content editing application.

5. The method of claim 1, wherein the display screen for the game content editing application includes two windows, a first content editing window occupying a first portion of the display screen and a second content editing window occupying a second portion of the display screen, such that two users are enabled to edit content using the same user interface.

6. The method of claim 1, further comprising providing a chat channel between at least two users.

7. The method of claim 1, further comprising providing to a user a game budget with a predetermined number of points, wherein if a user adds, deletes, or edits game items, properties, or maps using the game content editing application, the number of points in the game budget is debited or credited accordingly.

8. In a multiplayer game environment in which game content may be both edited and consumed, a method of game content editing, comprising:

placing a game server in signal communication with a network, the network accessible by a plurality of game clients, the game server and game clients defining a multiplayer environment;

transferring from the game server to the plurality of game clients a game playing application, the game playing application at least allowing a user to play a multiplayer game incorporating game items, game properties, or game maps in the multiplayer environment;

transferring from the game server to at least one of the plurality of clients a game content editing application, the game content editing application at least enabling one user to edit game content in the multiplayer environment, in which the enabling includes enabling the user to add, delete, or edit game items, properties, or maps while a game is being played; and displaying a user interface for the game playing application and the game content editing application while a game is being played, such that the user interface for the game playing application occupies a first portion of a display screen to display an area of the game and the user interface for the game content editing application occupies a second portion of the display screen and displays the same area of the game.

9. The method of claim 8, wherein the user can incorporate into the game being played any additions, edits, or deletions of game items, properties, or maps made using the game content editing application.

10. In a multi-user environment in which content may be both edited and consumed, a non-transitory computer-readable storage device encoded with computer executable instructions which, when executed by a processor, cause a computer to perform the steps of:

arranging a server in signal communication with a network, the network accessible by a plurality of clients, the server and clients defining a multi-user environment;

transferring from the server to the plurality of clients a first application, the first application at least allowing a user to consume content in the multi-user environment;

transferring from the server to at least one of the plurality of clients a second application, the second application at least allowing a user to edit content being consumed using the first application in the multi-user environment;

displaying user interfaces for the first application and the second application on respective different display screens;

displaying a toggle switch on the first application display screen for permitting the user to switch from the first application display screen to the second application display screen while content is being consumed using the first application; and displaying a toggle switch on the second application display screen for permitting the user to switch the user interface from the second application display screen to the first application display screen after the user has made any edits to the content using the second application user interface, wherein the user can incorporate any said edits into the content being consumed using the first application.

11. The storage device of claim 10, in which the first and second applications are combined into a single application, and in which the transfer of the first application and the transfer of the second application are combined into a transfer of the single application.

12. The storage device of claim 11, in which the instructions further cause a computer to define at least one of the plurality of clients as an administrator, in which the administrator client can enable or disable the second application on each of the other clients of the plurality.

13. The storage device of claim 10, in which the instructions further cause a computer to enable a chat channel between at least two users who are editing content in the multi-user environment.

* * * * *